United States Patent [19]

Suchsland et al.

[11] 4,098,206

[45] Jul. 4, 1978

[54] ELECTRONIC MOTOR SPEED REGULATING SYSTEM HAVING ADJUSTABLE HIGH AND LOW SPEED RANGES

[75] Inventors: Alfred Rolf Suchsland, Morris Plains; Raymond Steven Tyburcy, Middletown; Charles Robert Odermann, Montville, all of N.J.

[73] Assignee: The Singer Company, New York, N.Y.

[21] Appl. No.: 797,888

[22] Filed: May 17, 1977

[51] Int. Cl.[2] ..... D05B 69/18

[52] U.S. Cl. ..... 112/220; 112/277

[58] Field of Search ..... 112/277, 275, 220, 221

[56] References Cited

U.S. PATENT DOCUMENTS

| | | | |
|---|---|---|---|
| 3,319,591 | 5/1967 | Hamlett | 112/220 |
| 3,364,452 | 1/1968 | Thompson et al. | 112/277 X |
| 3,789,783 | 2/1974 | Cook et al. | 112/220 |

*Primary Examiner*—Werner H. Schroeder
*Assistant Examiner*—Peter Nerbun
*Attorney, Agent, or Firm*—Robert E. Smith; Edward L. Bell; Julian Falk

[57] ABSTRACT

A sewing machine motor speed regulating system which provides two speed ranges which, in turn, have independently controllable maximum attainable speed adjust. This is accomplished by selectively exciting one of two variable trim resistors serially inserted in the silicon controlled rectifier gate/controller circuit.

7 Claims, 2 Drawing Figures

ELECTRONIC MOTOR SPEED REGULATING SYSTEM HAVING ADJUSTABLE HIGH AND LOW SPEED RANGES

BACKGROUND OF THE INVENTION

This invention relates to motor speed control systems, and in particular, means for controlling the speed of a sewing machine motor.

In a sewing machine, when the speed thereof becomes excessive, the quality of the stitches formed may deteriorate. Therefore, it is highly desirable to be able to control and limit the maximum attainable speed of the sewing machine. More to this point, with the advent of multitype stitch sewing machines, there may be forms of stitching which require a lower maximum speed than the others. This requirement has led to sewing machine motor control systems which selectively provide two speed ranges over which the sewing machine may operate. U.S. Pat. No. 3,789,783 to Cook et al, discloses an electronic speed regulating system having two speed ranges for the sewing machine motor. These speed ranges are achieved by inserting two fixed resistors in a series in the silicon controlled rectifier gate/motor controller circuit and by selectively bridging one of the resistors. However, in any attempt to adjust the maximum speed in either speed range, the drawbacks of this arrangement become apparent, namely, the difficulty of physically changing the resistors and the fact that the value of one is dependent upon the value of the other.

SUMMARY OF THE INVENTION

The object of this invention is to provide an electronic motor speed regulating system having two speed ranges with independent maximum speed adjustment capability in each of the speed ranges. This object is achieved by inserting two variable trim resistors in series with the motor controller and then by selectively exciting either one of the trim resistors.

With the above and additional objects and advantages in view as will hereinafter appear, this invention will be described in reference to the accompanying drawing of the preferred embodiment.

DESCRIPTION OF THE PREFERRED EMBODIMENT

Figure 1:
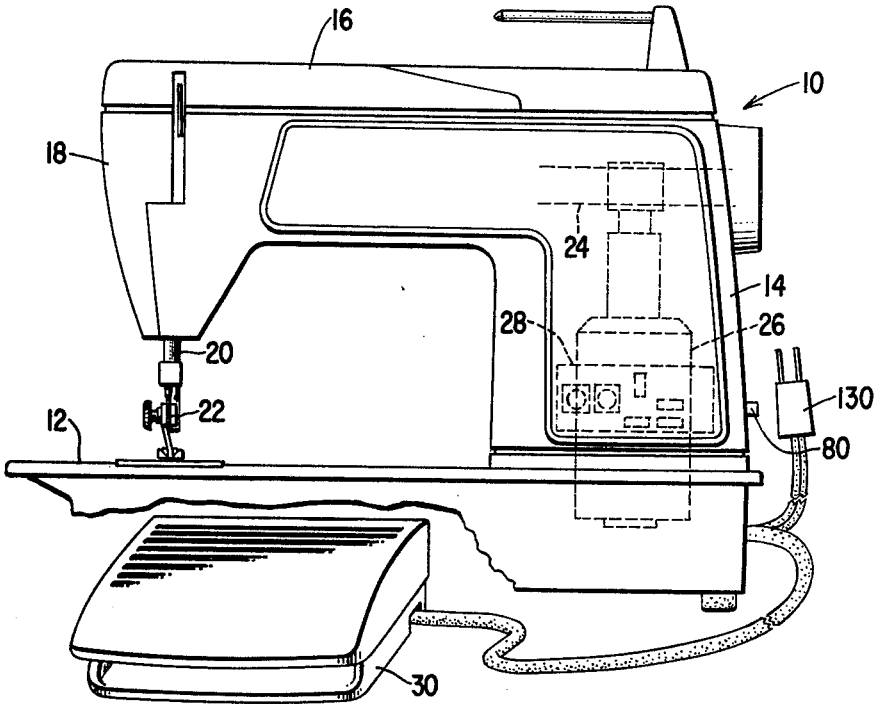
FIG. 1 is a front elevational view of a sewing machine having the invention incorporated therein.

Referring to FIG. 1 of the drawings, a sewing machine is generally indicated at 10. The sewing machine 10 includes a bed 12, an upright standard 14, a bracket arm 16 extending from the standard 14 overhanging the bed 12, and a sewing head 18 at the end of the bracket arm 14. Arranged within the sewing head 18 for endwise reciprocatory motion, is a needle bar 20, having a thread carrying needle 22 attached thereto. Contained within the bracket arm 16 is a drive shaft 24 for effecting the reciprocatory motion of the needle bar 20. An electric motor 26 is located in the standard 14 for imparting rotary motion to the drive shaft 24. In close proximity to the motor 26 is a motor control module 28 which, in conjunction with the motor 26 and a remote foot controller 30, forms the electronic motor speed regulating system of this invention.

Figure 2:
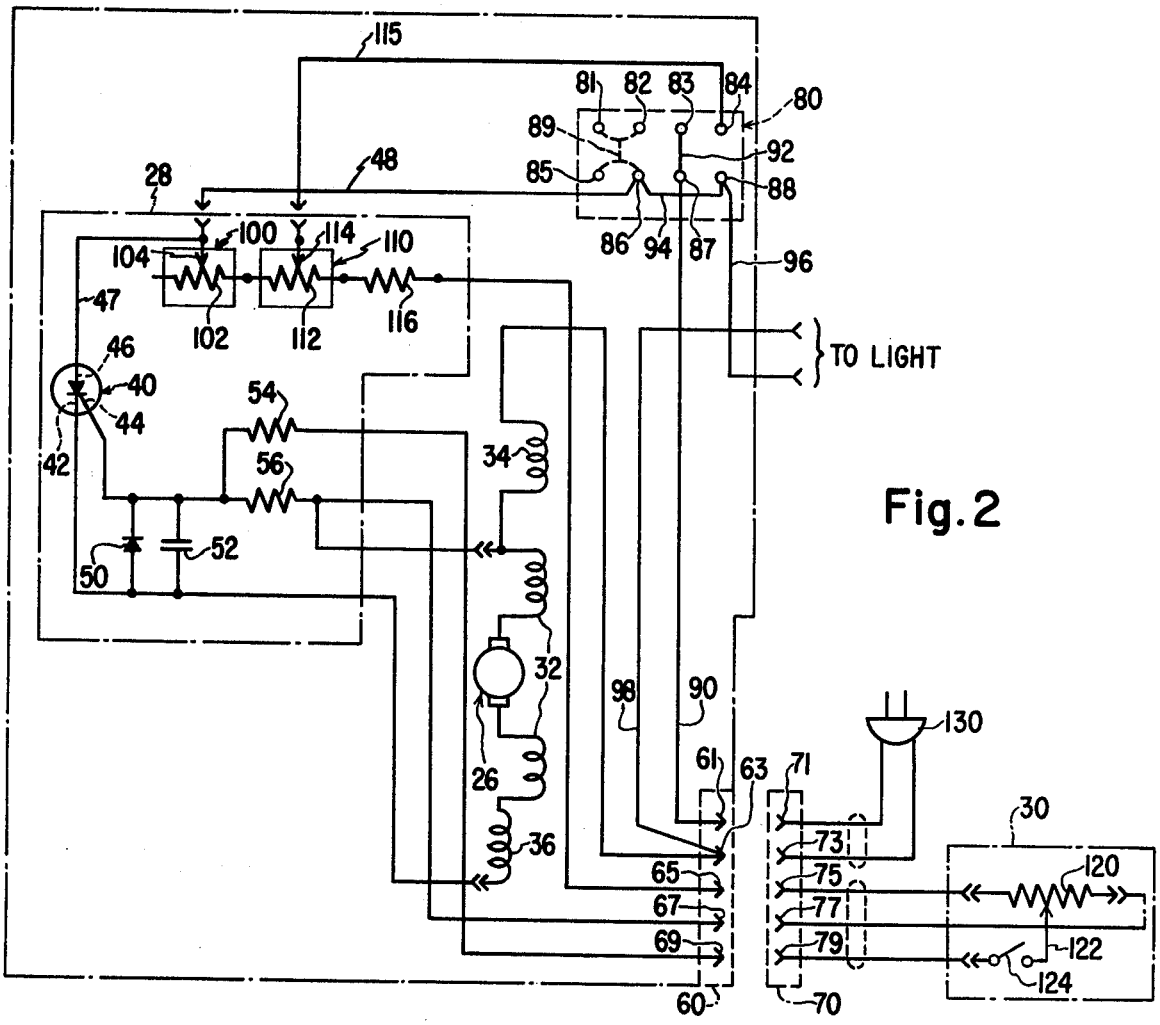
FIG. 2 is an electrical schematic of the electronic motor speed regulating system of this invention.

As shown in the electrical schematic of FIG. 2, the motor 26 is shown as having an armature winding 32 and field windings 34 and 36. The motor control module 28 contains a silicon controlled rectifier 40 (SCR) having a cathode 42 connected to the end of the field winding 36. A diode 50 has its cathode connected to the gate 44 of SCR 40 and its anode connected to the cathode 42 of SCR 40. In parallel with the diode 50 and connected across the gate 44 and cathode 42 of SCR 40 is a capacitor 52.

As further shown in FIG. 2, the motor 26 and motor control module 28 are connected to the foot controller 30 and a power source by means of a socket 60 and mating plug 70 having terminals 61, 63, 65, 67, 69 and 71, 73, 75, 77, 79, respectively.

A first resistor 54 is shown having one end connected to the gate 44 of SCR 40 and the other end connected to terminal 69 of socket 60. A second resistor 56 is shown also having one end connected to the gate 44 of the SCR 40 and the other end connected both to terminal 67 of socket 60 and to the junction of the field winding 34 and the motor armature winding 32. The free end of the field winding 34 is then connected to terminal 63 of socket 60.

A switch 80 is provided for energizing the sewing machine 10 and for selecting between the high and low speed ranges. The switch 80 has two sets of terminals, 81 through 84 and 85 through 88, and a sliding wiper 89 for connecting any two adjacent terminals in each set to each other.

The anode 46 of SCR 40 is connected to terminal 86 of switch 80 by wires 47 and 48. Terminal 87 of switch 80 is connected to terminals 61 of socket 60 by a wire 90. Jumpers 92 and 94 interconnect terminals 83 to 87 and 86 to 88, respectively. Terminal 88 is also connected to a sewing light (not shown) by lead wire 96; the return wire 98 from the light being connected to terminal 63 of socket 60.

To allow for the adjustable speed ranges, two potentiometers, 100 and 110, are provided having the resistive courses thereof, 102 and 112, respectively, connected in series along with a third resistor 116 to terminal 65 of socket 60. The wiper 104 of potentiometer 100, the low speed adjust, is connected to terminal 86 of switch 80 while the wiper 114 of potentiometer 110, the high speed adjust, is connected to terminal 84 of switch 80 by wire 115.

The foot controller 30 contains a potentiometer having a resistive element 120 connected between terminals 75 and 77 of plug 70. The potentiometer wiper 122 is connected to an on/off switch 124 which is, in turn, connected to terminal 79 of plug 70. For providing power to the sewing machine, a standard 110 volt, 60 cycle, AC plug 130 is shown connected to terminals 71 and 73 of plug 70.

In operation, with reference to FIG. 2, when plug 70 is mated with socket 60 and AC plug 130 is connected to a power source, the sliding wiper 89 of switch 80 is moved to the right to a first position interconnecting terminals 82 to 83 and 86 to 87. In this position, power is supplied to the SCR 40 and to the wiper 104 of the low speed adjust potentiometer 100, through the resistive portion 112 of potentiometer 110 and the resistor 116 and on through the foot controller 30 to the gate 44 of SCR 40. When the sliding wiper 89 is moved further to the right to a second position interconnecting switch terminals 83 to 84 and 87 to 88, power is applied to the wiper 114 of potentiometer 110, effectively shorting out potentiometer 100 thus quantumly reducing the overall impedance in the SCR gate circuit. When the switch is in the first position, the maximum speed in this range may be adjusted by varying potentiometer 100. Since, in this position, there is no electrical connection to the wiper 114 of potentiometer 110, the positioning thereof has no effect on the circuit. When the switch 80 is in the second position, adjustment of the maximum motor speed in this range is accomplished by varying potentiometer 110. Since potentiometer 100 is now shorted out, any setting thereof has no effect on the circuit.

As is shown in the foregoing, a novel method of providing motor regulating system featuring two speed ranges having independently controllable maximum speeds is accomplished by selectively exciting one of a pair of trim potentiometers wired serially with the motor controller for varying the current being supplied to the SCR gate.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims.

Having thus set forth the nature of the invention, what we claim herein is:

1. In a sewing machine having an electric motor for driving said sewing machine, an electronic motor speed regulating system comprising means for selectively providing at least two separate predetermined speed ranges for said electric motor, means for varying the speed of said motor within the selected speed range, and means for independently preadjusting the maximum attainable speed of said motor in each of said speed ranges, whereby the adjusting of the maximum attainable speed in one of said speed ranges will not affect the previously set maximum attainable speed in the other of said speed ranges.

2. A speed regulating system as set forth in claim 1 wherein said means for selectively providing said speed ranges includes resistive elements and means for selectively connecting said resistive elements to said motor.

3. A speed regulating system as set forth in claim 2 wherein said resistive elements are each manually variable thereby providing said means for independently adjusting the maximum attainable speed of said motor in each of said speed ranges.

4. A speed regulating system as set forth in claim 1 wherein said varying means includes a variable resistance-type motor controller.

5. A speed regulating system as set forth in claim 4 wherein said varying means further includes a silicon controlled rectifier having a gate terminal, said gate terminal being electrically connected to said motor controller whereby said motor controller varies a voltage applied to said gate terminal which, in turn, controls the firing of said silicon controlled rectifier.

6. A speed regulating system as set forth in claim 5 wherein said selective means includes resistive elements and means for selectively connecting said resistive elements serially to said silicon controlled rectifier gate and motor controller circuit.

7. A speed regulating system as set forth in claim 6 wherein said resistive elements are each manually variable for independently adjusting the maximum attainable speed of said motor in each of said speed ranges.

* * * * *